US007765989B2

(12) United States Patent
Maruyama

(10) Patent No.: US 7,765,989 B2
(45) Date of Patent: Aug. 3, 2010

(54) FUEL PUMP DRIVING DEVICE

(75) Inventor: Noriyoshi Maruyama, Fujisawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 204 days.

(21) Appl. No.: 12/042,000

(22) Filed: Mar. 4, 2008

(65) Prior Publication Data

US 2008/0251051 A1 Oct. 16, 2008

(30) Foreign Application Priority Data

Apr. 10, 2007 (JP) ..... 2007-102500
Dec. 25, 2007 (JP) ..... 2007-332388

(51) Int. Cl.
*F02M 37/06* (2006.01)
*F02M 37/04* (2006.01)

(52) U.S. Cl. ..... 123/508; 123/90.31

(58) Field of Classification Search ..... 123/192.2, 123/90.31, 90.34, 54.4, 90.17, 198 R, 198 L, 123/508

See application file for complete search history.

(56) References Cited

U.S. PATENT DOCUMENTS 2,895,462 A * 7/1959 Champ ..... 123/525
3,338,229 A * 8/1967 De Lorean et al. ..... 123/195 A
5,564,380 A 10/1996 Kobayashi et al.
2002/0023616 A1* 2/2002 Stone ..... 123/198 R
2006/0201465 A1* 9/2006 Stone ..... 123/90.31

FOREIGN PATENT DOCUMENTS

EP 0 715 059 A2 6/1996
JP 2005-036711 A 2/2005

* cited by examiner

*Primary Examiner*—Mahmoud Gimie
(74) *Attorney, Agent, or Firm*—Foley & Lardner LLP

(57) ABSTRACT

A fuel-pump-driving device (20) drives a plunger (31) of a fuel pump (30) to perform a reciprocating motion to supply fuel to an internal combustion engine. The fuel-pump-driving device (20) comprises a cam (27) that drives the plunger (31) according to the rotation of a fuel-pump-driving sprocket (26). The fuel-pump-driving sprocket (26) meshes with a chain (7A) which travels between a crank sprocket (3) and a valve-driving sprocket (5A) of the engine. Since the fuel-pump-driving sprocket (26) can be located in a position detached from the valve-driving sprocket (5A), the fuel-pump-driving device (20) has greater freedom of layout and the fuel pump (30) exhibits a better performance than in a case where the plunger (31) is driven by a cam that is fixed directly to the cam shaft (5) of the valve-driving sprocket (5A).

10 Claims, 7 Drawing Sheets

FUEL PUMP DRIVING DEVICE

FIELD OF THE INVENTION

This invention relates to a driving device for a fuel pump which supplies fuel to an internal combustion engine.

BACKGROUND OF THE INVENTION

JP 2005-036711A, published by the Japan Patent Office in 2005, discloses a fuel pump which supplies fuel to an internal combustion engine.

The internal combustion engine comprises intake valves and exhaust valves as well as a camshaft which rotates in a fixed relation with the rotation of the engine to open and close the intake valves and exhaust valves. A crank sprocket is fixed to the crankshaft and a valve-driving sprocket is fixed to the camshaft. A timing chain is wrapped around the crank sprocket and the valve-driving sprocket to transmit the rotational force of the crankshaft to the camshaft. Valve-driving cams are fixed to the camshaft to open/close the intake valves and the exhaust valves when the camshaft is rotated by the rotational force of the camshaft.

The fuel pump comprises a pressure chamber delimited by a plunger. A lifter is fixed to the plunger and kept in contact with a fuel-pump-driving cam fixed to the camshaft together with the valve-driving cams.

When the engine operates, the camshaft rotates, and the fuel-pump-driving cam fixed to the camshaft causes the plunger to perform a reciprocating motion via the lifter such that the pressure chamber expands and shrinks alternately. When the pressure chamber expands, fuel is suctioned into the pressure chamber, and when the pressure chamber shrinks, the fuel in the pressure chamber is pressurized and discharged into a fuel passage of the internal combustion engine.

SUMMARY OF THE INVENTION

Since the fuel-pump-driving cam is fixed to the camshaft together with the valve-driving cams, a space for the pump-driving cam may be limited by the arrangement of the valve-driving cams and related members.

Further, since the lifter is driven by the pump-driving cam fixed to the cam camshaft, the performance of the fuel pump, such as the discharge pressure, depends on the rotation speed of the camshaft. As a result, a case where the fuel pump cannot satisfy the required performance may arise.

It is therefore an object of this invention to increase the freedom of layout of the fuel-pump-driving device as well as to increase the performance of the fuel pump.

In order to achieve the above object, this invention provides a fuel-pump-driving device for a fuel pump which supplies fuel to an internal combustion engine. The internal combustion engine comprises a crankshaft, a rotational drive member fixed to the crankshaft, a rotational driven member, and an endless torque transmitting member wrapped around the rotational drive member and the rotational driven member.

The fuel-pump-driving device comprises a rotational fuel-pump-driving member which is engaged with the endless torque transmitting member between the rotational drive member and the rotational driven member, and drives the fuel pump when rotated.

The details as well as other features and advantages of this invention are set forth in the remainder of the specification and are shown in the accompanying drawings.

DESCRIPTION OF THE PREFERRED EMBODIMENTS

Figure 1:
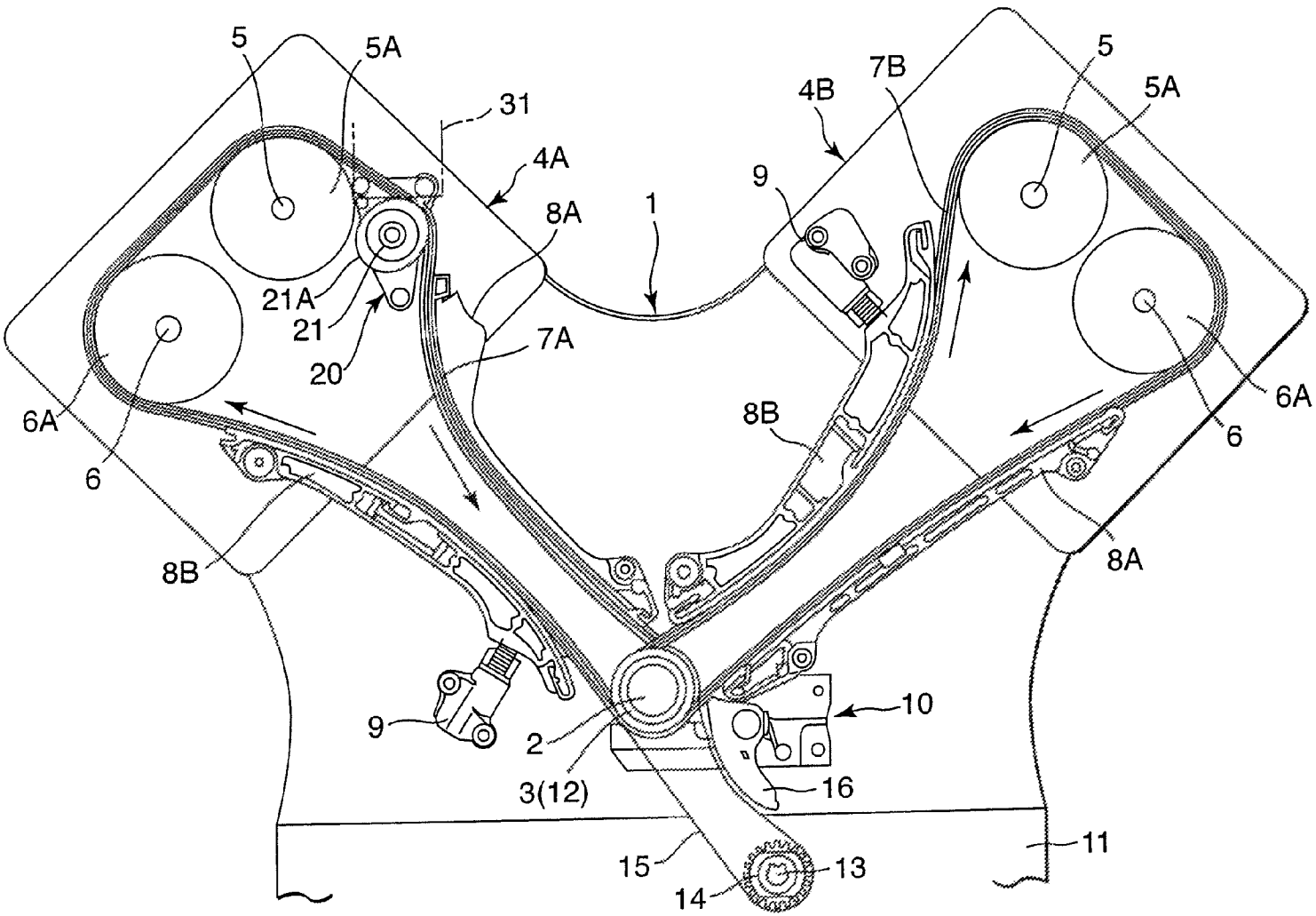
FIG. 1 is a front view of essential parts of a V-shaped internal combustion engine provided with a fuel pump and a fuel-pump-driving device according to this invention.

Referring to FIG. 1 of the drawings, a fuel-pump-driving device 20 operates with a rotational force transferred by a timing chain 7A of a V-shaped internal combustion engine, which serves as an endless torque transmitting member.

The internal combustion engine comprises a crankshaft 2 projecting outward from a cylinder block 1. A crank sprocket 3 serving as a rotational drive member is fixed to a projecting end of the crankshaft 2. A pair of cylinder heads 4A and 4B are fixed to an upper end of the cylinder block 1. An intake camshaft 5 for opening and closing intake valves and an exhaust camshaft 6 for opening and closing exhaust valves project respectively outward from each of the cylinder heads 4A and 4B. A valve-driving sprocket 5A serving as a rotational driven member is fixed to a projecting end of the intake camshaft 5, and a valve-driving sprocket 6A that also serves as a rotational driven member is fixed to a projecting end of the exhaust camshaft 6.

The timing chain 7A is wrapped around the crank sprocket 3 and the valve-driving sprockets 5A and 6A disposed on the cylinder head 4A. The internal combustion engine comprises another timing chain 7B which is wrapped around the crank sprocket 3 and the valve-driving sprockets 5A and 6A disposed on the cylinder head 4B.

The timing chains 7A and 7B travel clockwise as shown by the arrows in the figure, in which the internal combustion engine is viewed from the front. Guide rails 8A are fixed onto the outer surface of the cylinder block 1 so as to face a tension side of the timing chains 7A and 7B which transfers the rotational force of the crank sprocket 3.

Movable tension rails 8B are fitted onto the outer surface of the cylinder block 1 so as to face a slack side of the timing chains 7A and 7B. The tension rail 8B is pushed by a chain tensioner 9 and exerts a pressure on the timing chains 7A and 7B laterally so as to regulate the tension of the timing chains 7A and 7B.

An oil pan 11 is fixed to a lower end of the cylinder block 1. A guide bracket 10 is fixed to the outer surface of the cylinder block 1 near the crank sprocket 3 so as to prevent slippage of the timing chains 7A and 7B.

An oil-pump-driving shaft 13 projects outward from the oil pan 11. An oil-pump-driving sprocket 14 is fixed to a projecting end of the oil-pump-driving shaft 13. Another crank sprocket 12 is fixed to the crankshaft 2 in parallel with the crank sprocket 3. A chain 15 is wrapped around the sprockets 12 and 14. The oil pump is driven by a rotational force of the crankshaft 2 transmitted to the oil-pump-driving shaft 13 from the crankshaft 2 via the sprockets 12, 14 and the chain 15. A movable tension rail 16 is fitted onto the outer surface of the oil pan 11 in contact with a slack side of the chain 15 to regulate the tension of the chain 15.

The fuel-pump-driving device 20 is disposed on the cylinder head 4A. More specifically, the fuel-pump-driving device 20 is disposed on a downstream side of the valve-driving sprocket 5A with respect to the direction of travel of the timing chain 7A. Herein, the downstream side of the valve-driving sprocket 5A with respect to the direction of travel of the timing chain 7A corresponds to the inner side of the cylinder head 4A which is near to the cylinder head 4B.

Figure 2:
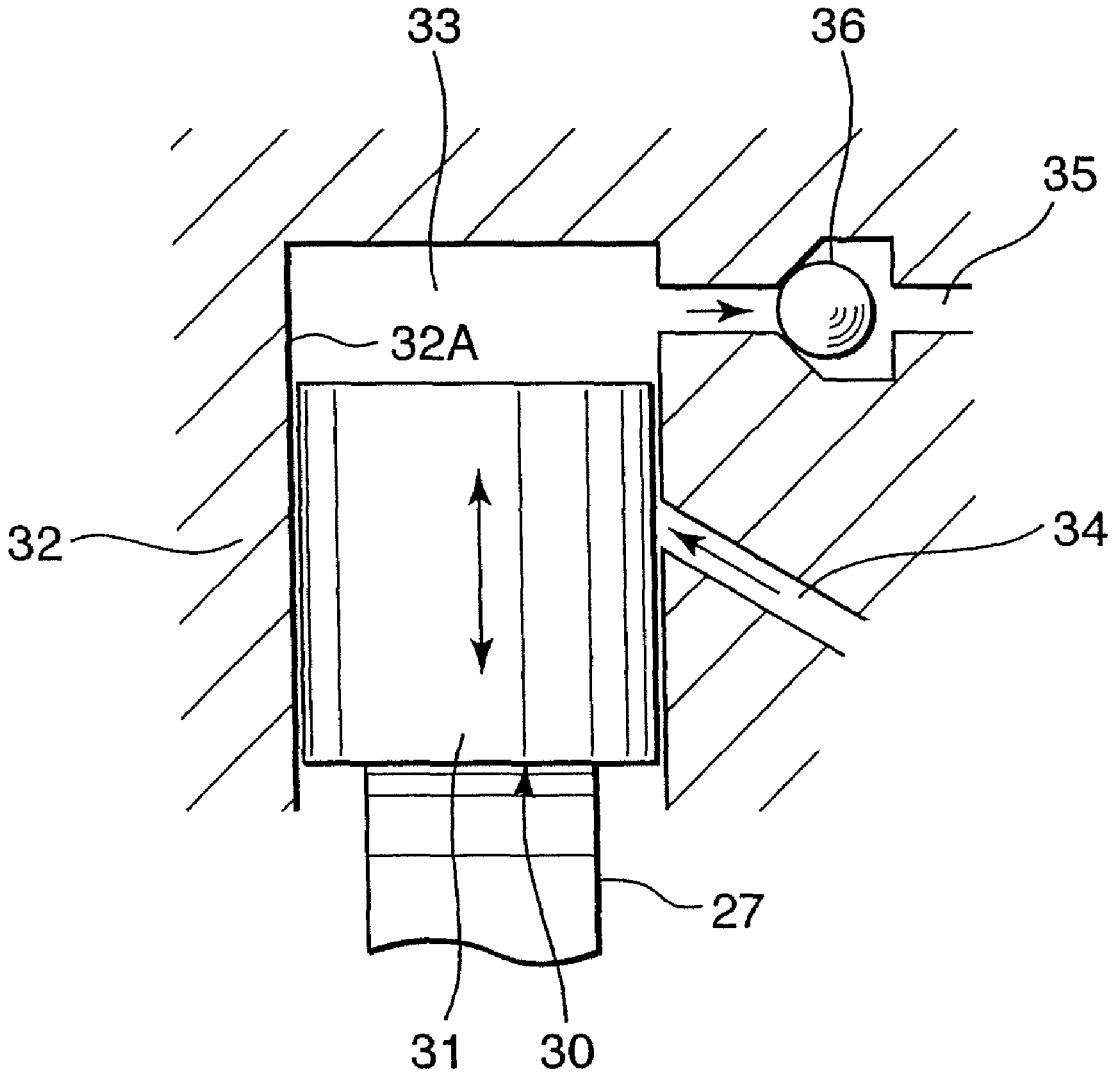
FIG. 2 is a schematic diagram of the fuel pump, illustrating an operating principle thereof.

Referring to FIG. 2, a fuel pump 30 which is driven by the fuel-pump-driving device 20 is a so-called plunger pump provided with a plunger 31 which performs a reciprocating motion. The plunger 31 is fitted into a cylinder 32A formed in a housing 32 so as to be free to slide. A pressure chamber 33 is delimited in the cylinder 32A by the plunger 31.

The pressure chamber 33 expands and shrinks according to the reciprocating motion of the plunger 31 in the cylinder 32A. A fuel suction passage 34 and a fuel discharge passage 35, each of which has an opening onto the cylinder 32A, are formed in the housing 32.

The opening of the fuel suction passage 34 is formed in a position which makes the fuel suction passage 34 communicate with the pressure chamber 33 only when the pressure chamber 33 is in an expanded state. The opening of the fuel discharge passage 35 is formed in a position which makes the fuel discharge passage 35 communicate with the pressure chamber 33 permanently.

A check valve 36 is installed in the fuel discharge passage 35. The check valve 36 allows fuel to be discharged from the pressure chamber 33 through the fuel discharge passage 35 while preventing a reverse flow of fuel in the fuel discharge passage 35. Although not shown in the figure, the plunger 31 is pushed by a resilient member in a direction to make the pressure chamber 33 expand.

When the plunger 31 slides in the cylinder 32A in a direction to make the pressure chamber 33 expand, the check valve 36 prevents fuel from flowing into the pressure chamber 33 from the fuel discharge passage 35 and the pressure in the pressure chamber 33 becomes negative. As a result, when the sliding plunger 31 reaches the position that allows the fuel suction passage 34 to communicate with the pressure chamber 33, fuel is suctioned into the pressure chamber through the fuel suction passage 34.

When the plunger 31 changes the direction of sliding and closes the fuel suction passage 34, the fuel in the pressure chamber 33 is pressurized as the capacity of the pressure chamber 33 decreases. The fuel thus pressurized in the pressure chamber 33 opens the check valve 36 and is discharged into the fuel discharge passage 35.

Next, the structure of the fuel-pump-driving device 20 for driving the fuel pump 30 will be described.

Figure 3:
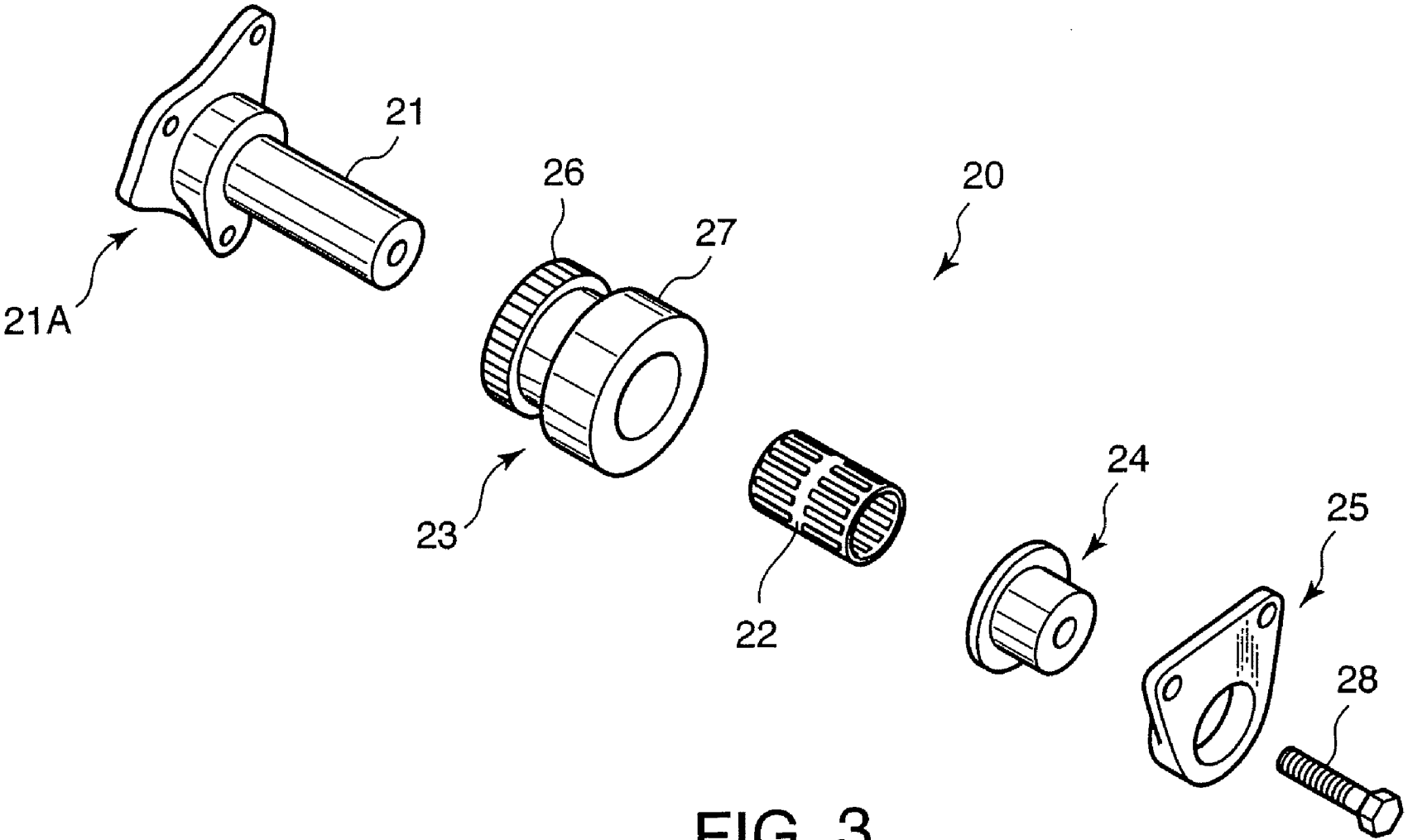
FIG. 3 is an exploded perspective view of the fuel-pump-driving device.

Referring to FIG. 3, the fuel-pump-driving device 20 comprises a shaft 21 supported on the outer surface of the cylinder head 4A, a cam unit 23, a spacer 24, and a bracket 25. The shaft 21 is fixed to the outer surface of the cylinder head 4A via a flange member 21A. The cam unit 23 is fitted onto the outer circumference of the shaft 21 via a bearing 22 so as to be free to rotate. The spacer 24 is fixed to a tip end of the shaft 21 using a bolt 28, thereby keeping the cam unit 23 in a predetermined axial position on the shaft 21. The bracket 25 and the spacer 24 prevent the shaft 21 from displacing in a lateral direction.

Figure 4:
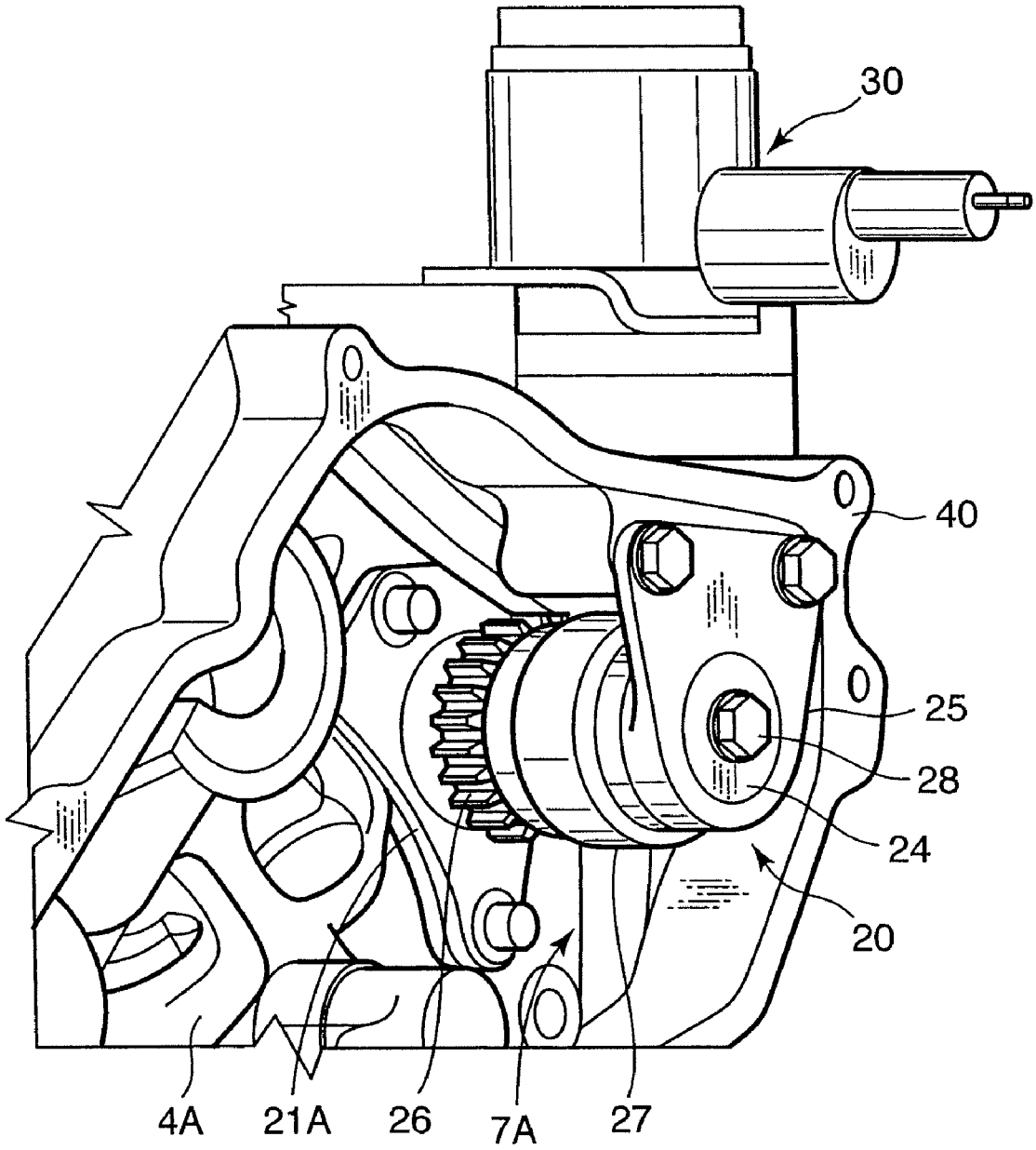
FIG. 4 is a perspective view of the fuel-pump-driving device fitted to a cylinder head of the internal combustion engine.

Referring to FIG. 4, the bracket 25 is fixed to a chain case 40 using bolts. The chain case 40 is a part of the cylinder head 4A or fixed thereto so as to enclose the timing chain 7A. The housing 32 of the fuel pump 30 shown in FIG. 3 is fixed to the chain case 40 or may be constructed as a part of the chain case 40.

A fuel-pump-driving sprocket 6A and a cam 27 are formed coaxially on the cam unit 23. The fuel-pump-driving sprocket 6A meshes with the timing chain 7A. The cam 27 is in contact with the bottom surface of the plunger 31 of the fuel pump 30 so as to be free to slide. The stroke distance of the plunger 31 of the fuel pump 30 depends on a cam profile of the cam 27. Herein, the cam profile of the cam 27 is designed to have an oval shape such that the plunger 31 performs two reciprocating motions while the shaft 21 performs one rotation. The bearing 22 is constituted by a number of needle bearings as shown in FIG. 3 so as to support the cam unit 23 to rotate freely on the shaft 21.

Figure 5:
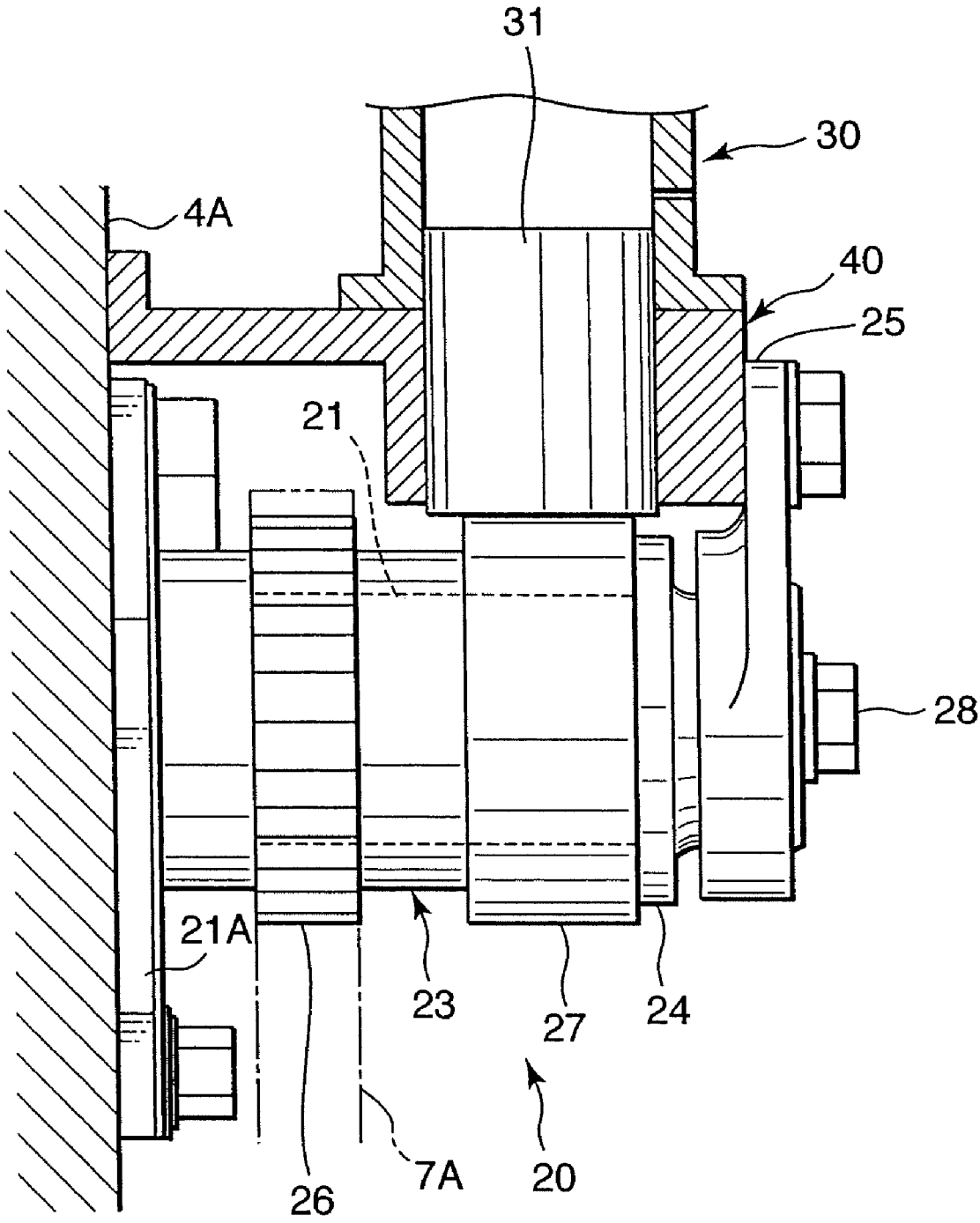
FIG. 5 is a side view of the fuel-pump-driving device fitted to the cylinder head of the internal combustion engine.

Referring to FIG. 5, a base end of the shaft 21 is supported by the cylinder head 4A via a flange member 21A while the tip end of the shaft 21 is supported by the chain case 40 via the spacer 24 and the bracket 25. The shaft 21 having both ends thus supported exhibits sufficient stability against the load exerted by the fuel-pump-driving sprocket 6A and the cam 27 in a radial direction. It is still possible however to support the shaft 21 as a cantilever by omitting the bracket 25.

The spacer 24 is supported by the bracket 25 so as to be free to slide in the axial direction. When a thermal expansion occurs in the chain case 40 and the fuel-pump-driving device 20, a dimensional error may be produced there-between. According to this fuel-pump-driving device 20, such an error is absorbed by the spacer 24 which can slide axially relative to the bracket 25.

Figure 6:
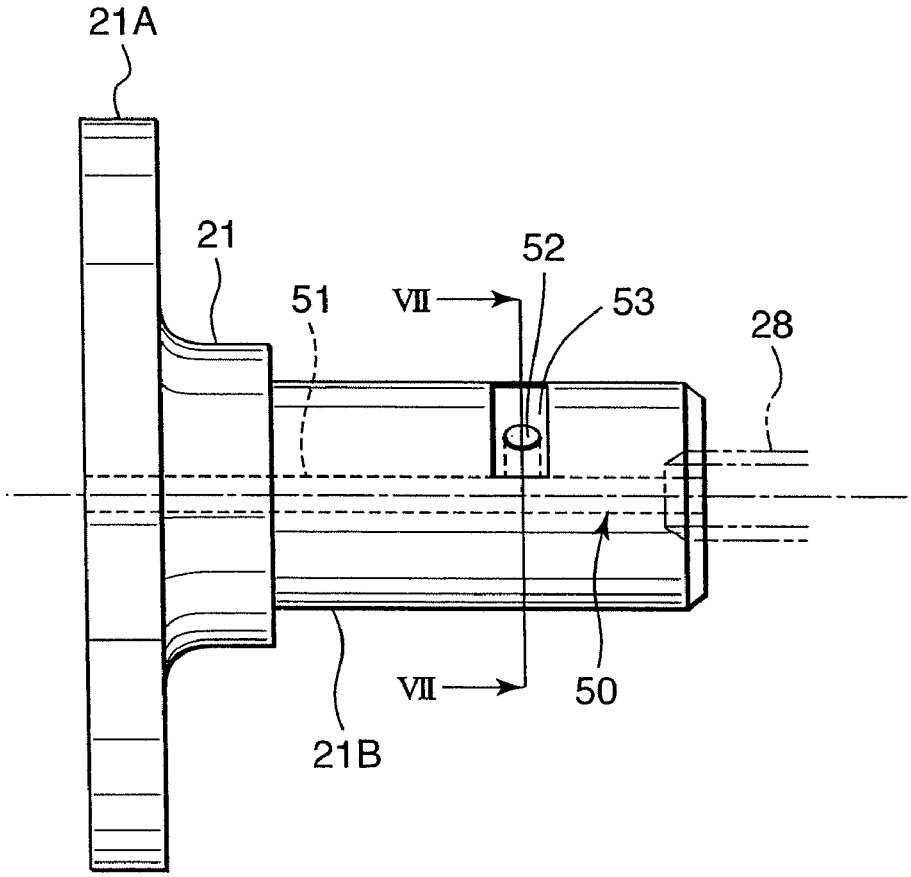
FIG. 6 is a side view of a shaft according to this invention, illustrating the construction of an oil passage.
Figure 7:
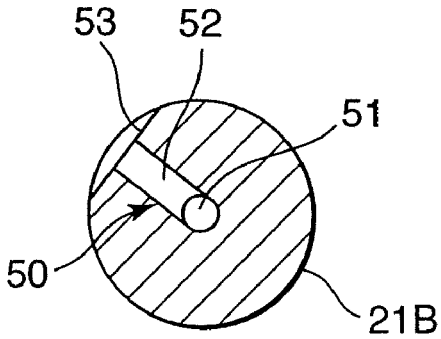
FIG. 7 is a cross-sectional view of the shaft taken along a line VII-VII in FIG. 6.

Referring to FIGS. 6 and 7, an oil passage 50 for supplying lubricating oil is formed through the shaft 21. The oil passage 50 functions to supply lubricating oil to the bearing 22 and a cam surface 27*b* of the cam 27 which is in contact with the plunger 31.

The oil passage 50 comprises a first oil path 51 formed axially through the center of the shaft 21 and a second oil path 52 which is formed radially in the shaft 21 from the outer circumference so as to be connected to the first oil path 51. The lubricating oil is supplied to a base end of the first oil path 51. The second oil path 52 has an opening in an outer surface 21B of the shaft 21 on which the bearing 22 rotates. A notch 53 which is formed by cutting a part of the sliding surface 21B is provided at the opening of the second oil path 52.

It should be noted that an opening of the first oil path 51 formed on the tip end of the shaft 21 is plugged by the bolt 28.

According to the construction described above, the lubricating oil supplied to the base end of the first oil path 51 is led to the notch 53 via the first oil path 51 and the second oil path 52. The lubricating oil thus stored in the notch 53 lubricates the bearing 22. The lubricating oil that has lubricated the bearing 22 is conveyed to the inner surface of the cam unit 23 by the needle bearings which roll as the shaft 21 and the cam unit 23 rotate relatively. The cam 27 has a through-hole which connects the inner surface and the cam surface 27*b* on the outer circumference thereof such that the lubricating oil on the inner surface of the cam unit 23 is conveyed to the cam surface 27*b* contacting with the plunger 31.

When the internal combustion engine operates, the fuel-pump-driving sprocket 26 rotates according to travel of the timing chain 7A and the cam 27 which forms the cam unit 23 together with the fuel-pump-driving sprocket 6A also rotates. The plunger 31 which is in contact with the cam surface 27*b* of the cam 27 then performs a reciprocating motion following the cam profile of the cam 27. As a result of the reciprocating motion of the plunger 31, the fuel pump 30 suctions fuel from the fuel suction passage 34, pressurizes the suctioned fuel, and discharges the pressurized fuel into the fuel discharge passage 35.

In this fuel-pump-driving device 20, the fuel-pump-driving sprocket 26 meshes with the timing chain 7A in a position detached from the intake camshaft 5 and the exhaust camshaft 6, and hence the cam 27 does not interfere with the valve-driving sprocket SA for driving the intake cam or the valve-driving sprocket 6A for driving the exhaust cam.

The fuel-pump-driving device 20 is located downstream of the valve-driving sprocket 5A with respect to the direction of travel of the timing chain 7A. Slackness in the timing chain 7A is greater on the downstream side of the crank sprocket 3 than the upstream side with respect to the direction of travel. In other words, the slackness is greater in a position facing the tension rail 8B than a position facing the guide rail 8A. When the slackness of the timing chain 7A is large, a phase delay may be promoted between the rotation angle of the crankshaft 2 and the corresponding operation timing of the fuel pump 30. In view of reducing this phase delay, it is preferable to dispose the fuel-pump-driving device 20 downstream of the valve-driving sprocket 5A.

It should be noted that, if the fuel-pump-driving device 20 were disposed on the cylinder head 4B, the downstream side of the valve-driving sprocket 5A would correspond to the outer side of the cylinder head 4B which is distant from the cylinder head 4A. In this internal combustion engine, the space on the outer side of the cylinder heads 4A and 4B is smaller than the space on the inner side thereof, and hence the fuel-pump-driving device 20 is preferably disposed on the cylinder head 4A in this embodiment.

The determination as to whether the fuel-pump-driving device 20 is disposed on the cylinder head 4A or on the cylinder head 4B should therefore be performed according to space availability.

It is possible to dispose the fuel-pump-driving device 20 on the cylinder block 1 instead of disposing it on the cylinder head 4A or 4B. The entire cylinder head 4A, 4B and the cylinder block 1 are referred to as an engine main body. The fuel-pump-driving device 20 may be disposed in any position on the engine main body.

Instead of driving the fuel-pump-driving sprocket 26 using the timing chain 7A or 7B, it is possible to drive the fuel-pump-driving sprocket 26 using another chain such as the chain 15 for driving the oil pump as long as the chain travels in a fixed relation with the rotation of the crankshaft 2.

As described above, the fuel-pump-driving device 20 has greater freedom of layout than the aforesaid prior art device in which the fuel-pump-driving cam is fixed onto the intake or exhaust camshaft. Similarly with respect to the dimensions of the fuel-pump-driving sprocket 26, the fuel-pump-driving device 20 has greater freedom than the prior art device.

The discharge flow rate of the fuel pump 30 depends on the rotation speed of the cam 27, and the rotation speed of the cam 27 depends on the number of teeth of the fuel-pump-driving sprocket 26. According to this fuel-pump-driving device 20, therefore, greater freedom is obtained in setting the fuel discharge flow rate of the fuel pump 30.

Further, since the fuel-pump-driving device 20 has the oil passage 50 formed in the shaft 21, lubricating oil is accumulated in the oil passage 50 even when the internal combustion engine is stationary, thereby ensuring lubrication of the bearing 22 and the cam surface 27*b* when the internal combustion engine starts to operate.

In this fuel-pump-driving device 20, both ends of the shaft 21 are supported by the cylinder head 4A and the timing chain case 40, respectively, as shown in FIGS. 4 and 5, and hence the shaft 21 has a stable supporting structure.

The bracket 25 supports the tip end of the shaft 21 via the spacer 24 on the timing chain case 40 such that the spacer 24 is free to slide in the axial direction. When a dimensional error arises due to thermal expansion of the timing chain case 40 and/or driving device 20, the error is absorbed by the spacer 40 which slides relative to the bracket 25 in the axial direction. This is also a preferable effect of this driving device 20.

Figure 8:
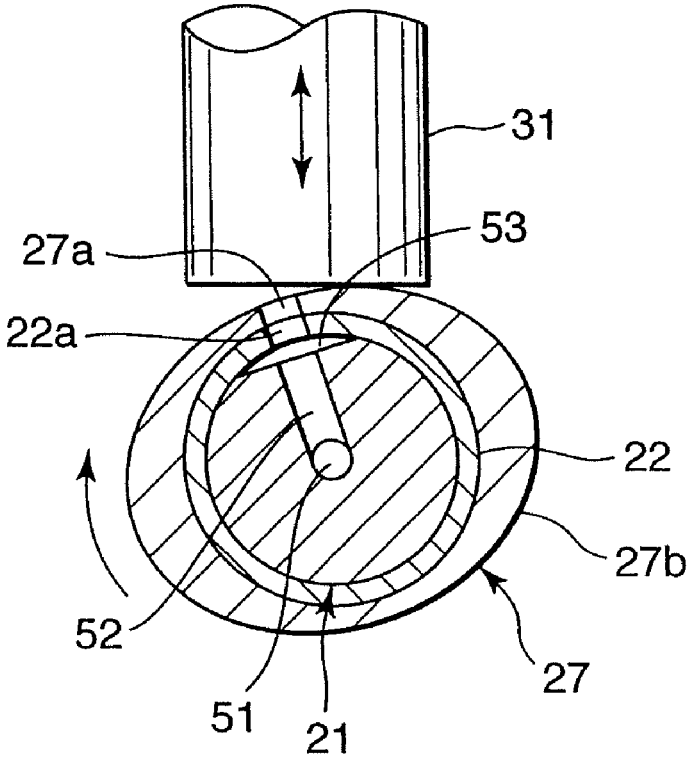
FIG. 8 is a cross-sectional view of a fuel-pump-driving device according to another embodiment of this invention.

Next, referring to FIG. 8, another embodiment of this invention relating to the lubricating structure of the fuel-pump-driving device 20 will be described.

According to this embodiment, instead of constituting the bearing 22 as a roller bearing using a number of needle bearings, the bearing 22 is constituted as a metal bearing, i.e. a type of slide bearing.

The bearing 22 has a cylindrical shape and is fitted onto the outer surface 21B of the shaft 21 so as to rotate relative to the shaft 21 when the cam unit 23 rotates. A through-hole 22*a* is formed radially in the bearing 22 so as to supply the lubricating oil in the notch 53 to the outer surface of the bearing 22.

The cam 27 is provided with two through-holes 27*a*, each having an opening facing the bearing 22 and an opening formed in the cam surface 27*b*. The opening of the through-hole 27*a* in the cam surface 27*b* is formed in a region of the cam surface 27*b* where the plunger 31 keeps the pressure chamber 33 in a most expanded state, or in other words a region corresponding to a base circle diameter of the cam 27. The opening should also be located in the vicinity of the point at which the cam 27 starts to drive the plunger 31. As described above, the cam 27 has an oval-shaped cam profile such that the plunger 31 performs two reciprocating motions while the cam 27 performs one rotation. The oval-shaped cam profile has two base circle diameter regions. The through-hole 27*a* is formed in each base circle diameter region such that the two through-holes are located at 180-degree intervals.

In the construction of the lubricating structure described above, the notch 53 of the shaft 21 communicates with the through-hole 27*a* and the lubricating oil is distributed to the cam surface 27*b* only when the notch 53, the through-hole 22*a* of the bearing 22, and the through-hole 27*a* of the cam 27 overlap, or in other words, only when the cam 27 is about to drive the plunger 31. Such an arrangement with respect to the supply of lubricating oil is preferable in suppressing the consumption of lubricating oil while ensuring lubrication of the cam surface 27*b*.

The contents of Tokugan 2007-102500, with a filing date of Apr. 10, 2007 in Japan, and Tokugan 2007-332388 with a filing date of Dec. 25, 2007 in Japan, are hereby incorporated by reference.

Although the invention has been described above with reference to certain embodiments of the invention, the invention is not limited to the embodiments described above. Modifications and variations of the embodiments described above will occur to those skilled in the art, within the scope of the claims.

Figure 9:
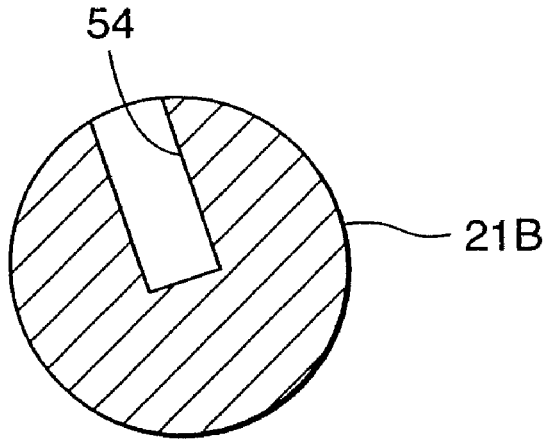
FIG. 9 is similar to FIG. 7, but shows yet another embodiment of this invention.

For example, as shown in FIG. 9, instead of forming the second oil path 52 and the notch 53 in the shaft 21, it is possible to bore a lateral hole 54 having a constant cross-section in the shaft 21 so as to be connected to the first oil path 51. In this construction, since the notch 53 is omitted, cutting work on the shaft 21 is simplified and the processing cost of the shaft 21 can be reduced.

Needless to say, this invention can be applied to an internal combustion engine which is provided with a timing belt and pulleys instead of the timing chain and the sprockets.

The embodiments of this invention in which an exclusive property or privilege is claimed are defined as follows:

What is claimed is:

1. A fuel-pump-driving device for a fuel pump which supplies fuel to an internal combustion engine, the internal combustion engine comprising a crankshaft, a rotational drive member fixed to the crankshaft, a rotational driven member, and an endless torque transmitting member wrapped around the rotational drive member and the rotational driven member, the fuel-pump-driving device comprising:

a rotational fuel-pump-driving member which is engaged with the endless torque transmitting member between the rotational drive member and the rotational driven member and drives the fuel pump when rotated, wherein the fuel-pump-driving member is engaged with the endless torque transmitting member in a position downstream of the rotational driven member with respect to a direction of travel of the endless torque transmitting member.

2. The fuel-pump-driving device as defined in claim 1, wherein the fuel pump comprises a plunger and supplies fuel to the internal combustion engine as the plunger performs a reciprocating motion, and the fuel-pump-driving device further comprises a cam which rotates together with the rotational fuel-pump-driving member and causes the plunger to perform the reciprocating motion.

3. The fuel-pump-driving device as defined in claim 2, wherein the rotational drive member is a crank sprocket fixed to the crankshaft, the rotational driven member is a valve-driving sprocket fixed to a camshaft of the internal combustion engine, and the endless torque transmitting member is a timing chain wrapped around the crank sprocket and the valve-driving sprocket.

4. The fuel-pump-driving device as defined in claim 3, wherein the internal combustion engine further comprises an engine main body, and the rotational fuel-pump-driving member is a fuel-pump-driving sprocket which is supported by the engine main body via a shaft.

5. The fuel-pump-driving device as defined in claim 4, wherein the internal combustion engine further comprises two cylinder heads disposed to form a V-shape, each of which comprises the valve-driving sprocket connected to the crank sprocket by an individual chain, and the fuel-pump-driving sprocket is disposed on one of the cylinder heads in which the position downstream of the valve-driving sprocket corresponds to an inner side of the cylinder head.

6. The fuel-pump-driving device as defined in claim 4, wherein the internal combustion engine further comprises a chain case fixed to the engine main body to enclose the timing chain, and an end of the shaft is supported by the engine main body while another end of the shaft is supported by the chain case.

7. The fuel-pump-driving device as defined in claim 6, further comprising a bracket fixed to the chain case and a spacer which is fixed to the another end of the shaft and supported by the bracket so as to be free to displace relative to the bracket in an axial direction of the shaft.

8. The fuel-pump-driving device as defined in claim 4, wherein the fuel-pump-driving sprocket and the cam are formed into a one-piece cam unit and supported on the shaft via a bearing so as to be free to rotate, and an oil passage is formed in the shaft to supply lubricating oil to the bearing.

9. The fuel-pump-driving device as defined in claim 8, wherein the cam has a cam surface which is in contact with the plunger and a through-hole to introduce lubricating oil from the bearing to the cam surface.

10. The fuel-pump-driving device as defined in claim 9, wherein the bearing is a cylindrical slide bearing having an inner circumference, an outer circumference, and a through-hole connecting the inner circumference and the outer circumference, the cam has a cam profile having a base circle region, and the relative locations of the through-hole of the cam, the through-hole of the bearing, and the oil passage are preset such that the through-hole of the cam is connected to the oil passage via the through-hole of the bearing only when the plunger is in contact with the base circle region.

* * * * *